US007770240B2

(12) United States Patent
Gdulla et al.

(10) Patent No.: US 7,770,240 B2
(45) Date of Patent: Aug. 10, 2010

(54) SAFETY HELMET WITH A BREATHING MASK

(75) Inventors: Manfred Gdulla, Lübeck (DE); Michael Rosert, Lübeck (DE); Dirk Feil, Lübeck (DE); Siegbert Tolk, Oldenburg (DE)

(73) Assignee: Dräger Safety AG & Co. KGaA, Lübeck (DE)

( * ) Notice: Subject to any disclaimer, the term of this patent is extended or adjusted under 35 U.S.C. 154(b) by 1104 days.

(21) Appl. No.: 11/383,617

(22) Filed: May 16, 2006

(65) Prior Publication Data

US 2006/0277665 A1 Dec. 14, 2006

(30) Foreign Application Priority Data

May 27, 2005 (DE) ..... 10 2005 024 508

(51) Int. Cl.
*A42B 1/24* (2006.01)

(52) U.S. Cl. ..... 2/424; 2/410

(58) Field of Classification Search ..... 2/410, 2/455, 424, 425, 432, 6.3, 6.4, 6.5, 6.7, 10, 2/12

See application file for complete search history.

(56) References Cited

U.S. PATENT DOCUMENTS

| | | | | | |
|---|---|---|---|---|---|
| 3,910,269 | A * | 10/1975 | Ansite et al. | ..... | 128/201.24 |
| 4,021,858 | A * | 5/1977 | Neeld et al. | ..... | 2/9 |
| 4,185,329 | A * | 1/1980 | Sarazen | ..... | 2/8.3 |
| 4,555,815 | A * | 12/1985 | Walther | ..... | 2/424 |
| 4,734,940 | A | 4/1988 | Galet et al. | | |
| 4,985,938 | A * | 1/1991 | Snow, Jr. | ..... | 2/424 |
| 6,795,978 | B2 * | 9/2004 | Fournier et al. | ..... | 2/424 |
| 6,795,979 | B2 * | 9/2004 | Fournier | ..... | 2/424 |

* cited by examiner

*Primary Examiner*—Tejash Patel
(74) *Attorney, Agent, or Firm*—McGlew and Tuttle, P.C.

(57) ABSTRACT

The connection of a breathing mask to a safety helmet provides increased wearing comfort. A fastening mount (12) with circular arc-shaped inner contour (14) is provided, and the bracket for the breathing mask has a projection corresponding thereto. The projection is in contact with the inner contour (14) of the fastening mount (12), so that the bracket is displaceable in relation to the fastening mount (12) in a rotatingly movable manner.

13 Claims, 1 Drawing Sheet

SAFETY HELMET WITH A BREATHING MASK

CROSS REFERENCE TO RELATED APPLICATIONS

This application claims the benefit of priority under 35 U.S.C. §119 of German Patent Application DE 10 2005 024 508.0 filed May 17, 2005, the entire contents of which are incorporated herein by reference.

FIELD OF THE INVENTION

The present invention pertains to a safety helmet with a breathing mask.

BACKGROUND OF THE INVENTION

A safety helmet with a bracket for a breathing mask is known from U.S. Pat. No. 4,734,940 (U.S. Pat. No. 4,734,940 is hereby incorporated by reference). The bracket is used to securely fasten the breathing mask on the shell of the helmet under varying conditions of use. The bracket is designed for this purpose as a component that is under spring tension and can be extended telescopically. Two opposite brackets are fastened for this purpose to the breathing mask in an articulated manner. The brackets have hook-shaped end pieces, which snap into fastening mounts on the lateral surfaces of the safety helmet. The safety helmet is pressed firmly against the face of the helmet's user by the spring tension of the brackets. To achieve uniform contact of the breathing mask with the face of the user of the helmet, the end pieces of the brackets can be displaced to a certain extent along the fastening mount. The bracket normally assumes a certain angular position in relation to the safety helmet. When the user of the helmet moves his head during use, stresses may develop between the breathing mask and the safety helmet, which can be compensated only by the axial displacement of the brackets. The contact pressure of the breathing mask with the face of the user of the helmet changes in the process, which is felt to be unpleasant.

SUMMARY OF THE INVENTION

The basic object of the present invention is to improve the connection of a breathing mask with a safety helmet concerning improved wearing comfort.

According to the invention, a safety helmet with a fastening mount for a bracket of a breathing mask is provided. The fastening mount has a circular arc-shaped contour. The bracket has a fastening means corresponding thereto in such a manner that the bracket is displaceable in relation to the fastening mount in a rotatingly movable manner.

The advantage of the present invention is that the fastening mount for the bracket of the breathing mask has a circular arc-shaped contour and a fastening means is formed at the free end of the bracket corresponding to the contour of the fastening mount. As a result, the bracket is rotatably movable and displaceable in relation to the fastening mount and an angular offset between the breathing mask and the safety helmet can be better compensated. The contour of the fastening mount and the corresponding contour on the fastening means is advantageously designed as a semicircle.

A locking means, which snaps in automatically and can be released by pressing a button, is advantageously provided between the fastening mount and the fastening means during the introduction of the fastening means into the fastening mount. The locking means is a spring element, in an embodiment, at the fastening mount, which locking means snaps into an undercut at the fastening means. To release the locking means, the spring element is deflected by means of a pushbutton and a push rod fastened in the bracket in such a way that it can perform lifting motion, and the bracket can be removed from the fastening mount. The undercut is likewise of a circular arc-shaped design. It is achieved as a result that the snapped-in bracket is also displaceable in relation to the fastening mount in a rotatingly movable manner.

An exemplary embodiment is shown in the drawings and will be explained in greater detail below. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
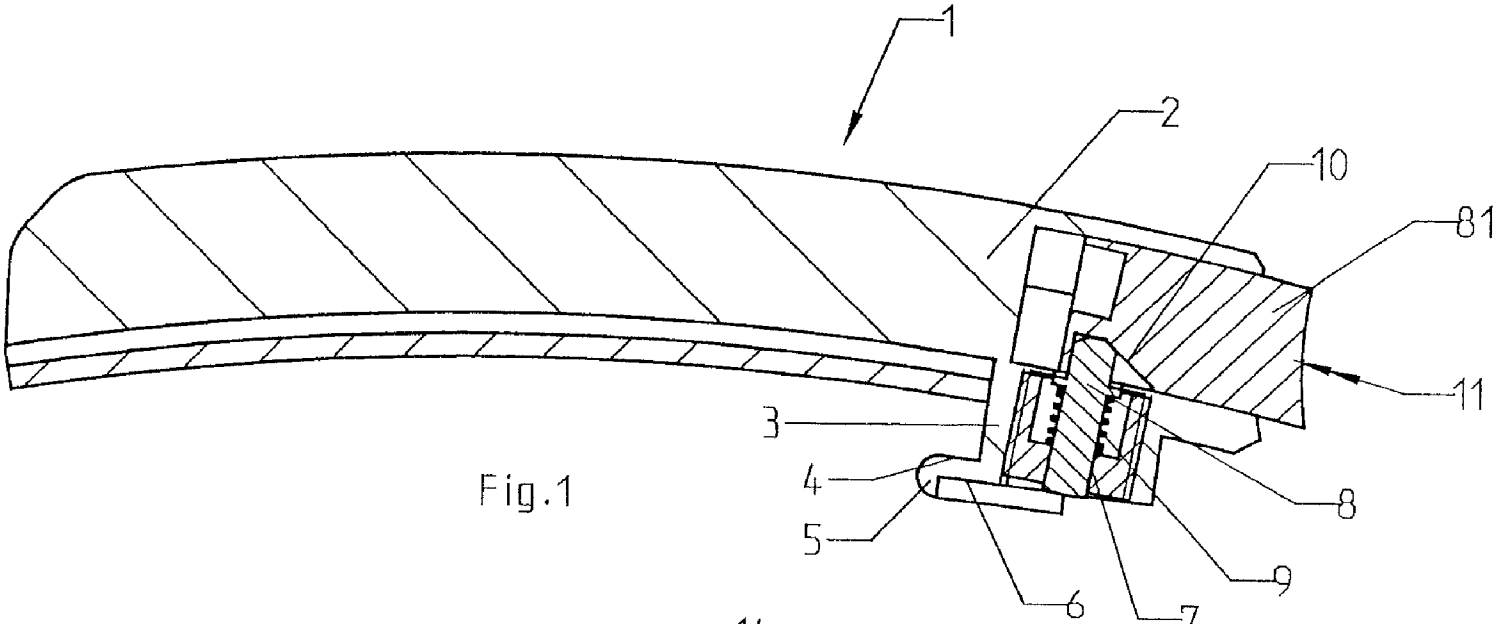
FIG. 1 is a bracket for a breathing mask.

Referring to the drawings in particular, FIG. 1 shows a sectional view of a detail of a breathing mask (not shown in greater detail) having a bracket 1. The bracket 1 comprises a holding arm 2, a hook-shaped end piece 3 and a fastening portion in the form of a projection 4 as a fastening means with a semicircular outer contour 5. On its underside, the projection 4 has an undercut 6, which encloses a semicircular area. A push rod 8 is accommodated in a hole 7 of the holding arm 2. The push rod 8 is pressed by a spring 9 against an oblique contact surface 10 of a pushbutton 81. During the actuation of the pushbutton 81 along arrow 11, the push rod 8 is displaced downward within the hole 7. The push rod 8 is flush with the surface of the undercut 6 in the state of rest.

Figure 2:
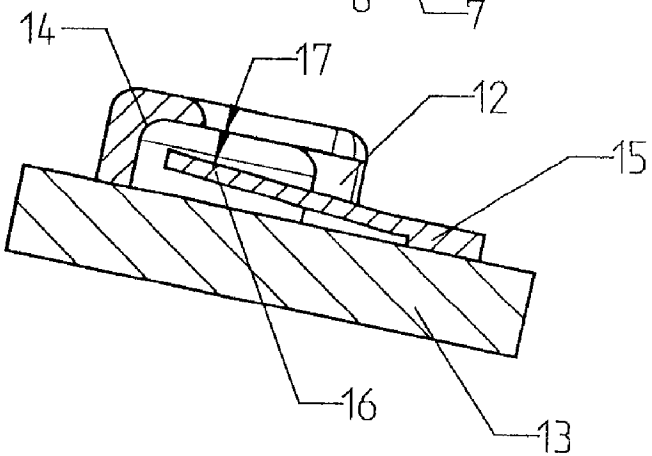
FIG. 2 is a fastening mount on a safety helmet.

FIG. 2 shows a sectional view of a fastening mount 12 on a safety helmet 13, which is shown as a detail only. The fastening mount 12 has a semicircularly extending inner contour 14, which has a shape corresponding to the outer contour 5 of the projection 4. On the underside, the fastening mount 12 has a contact surface 15 and a leaf spring 16 injection-molded in one piece with the contact surface 15.

When the bracket 1 is pushed into the fastening mount 12 and the outer contour 5 of the projection 4 is in contact with the inner contour 14 of the fastening mount 12, the leaf spring 16 snaps into the undercut 6 and the bracket 1 is locked in relation to the fastening mount 12. Only rotary motion of the bracket 1 in relation to the fastening mount 12 is possible. To detach the bracket 1, the leaf spring 16 is deflected downward by means of the push rod 8 in the direction of arrow 17 by actuating the pushbutton 81 and the projection 4 of the bracket 1 can be removed from the fastening mount 12.

While a specific embodiment of the invention has been shown and described in detail to illustrate the application of the principles of the invention, it will be understood that the invention may be embodied otherwise without departing from such principles.

What is claimed is:

1. A safety helmet, comprising:

a breathing mask bracket mounted on a breathing mask; and a fastening mount mounted on the safety helmet for receiving the bracket of a breathing mask, said fastening mount having a circular arc-shaped contour, said breathing mask bracket having a fastening means corresponding to said fastening mount for displacement of said bracket in relation to said fastening mount in a rotatingly movable manner when said breathing mask bracket is connected to said fastening mount, a contour of said fastening mount defining an inner contour and a contour of said fastening means defining an outer contour; a locking means which snaps in when said fastening mount and said fastening means are brought together, said locking means being provided between said fastening mount and said fastening means, said locking means including a pressing means that can release said locking means by pressing.

2. A safety helmet in accordance with claim 1, wherein said locking means contains an undercut at said fastening means on a side facing the safety helmet and a spring element snapping into said undercut during a bringing together motion.

3. A safety helmet in accordance with claim 2, further comprising a push rod fastened in such a way to perform lifting motion and remove said spring element from said undercut, said push rod being provided in an area of said fastening means.

4. A safety helmet with detachable respiratory mask combination comprising:

a breathing mask with a breathing mask bracket; and a safety helmet with a fastening mount for connection with said breathing mask bracket, said fastening mount having an arc-shaped contour, said breathing mask bracket having a fastening device with a fastening portion shaped corresponding to said fastening mount for being securely received therein and for rotating displacement of said bracket in relation to said fastening mount when securely received therein;

a locking means provided between said fastening mount and said fastening means for retaining said fastening portion with a snap action when said fastening mount and said fastening means are brought together, said locking means being arranged for rotating displacement of said breathing mask in relation to said fastening mount when said locking means retains said breathing mask bracket with said fastening mount said locking means including a pressing means that can release said fastening portion by pressing.

5. A combination in accordance with claim 4, wherein a contour of said fastening mount defines an inner contour and a contour of said fastening portion defines an outer contour.

6. A combination in accordance with claim 4, wherein said locking means contains an undercut at said fastening means on a side facing the safety helmet and a spring element snapping into said undercut during a bringing together motion.

7. A combination in accordance with claim 6, further comprising a push rod fastened in such a way to perform lifting motion and remove said spring element from said undercut, said push rod being provided in an area of said fastening means.

8. A safety helmet and detachable breathing mask combination, the combination comprising:

a breathing mask bracket mounted on the breathing mask, said breathing mask bracket including a fastening portion with an arc-shaped contour;

a fastening mount arranged on the safety helmet for receiving said fastening portion and forming a secure connection with said breathing mask bracket, said fastening mount having an arc-shaped contour corresponding to said arc-shaped contour of said fastening portion of said breathing mask bracket, said breathing mask bracket and said fastening mount being arranged for rotating displacement of said breathing mask bracket in relation to said fastening mount when said fastening mount is securely connected to said breathing mask bracket;

pressing means in said breathing mask bracket and said fastening mount for selectively releasing said fastening portion from said fastening mount when operated by a user of the safety helmet and breathing mask combination; locking structure in said breathing mask bracket and said fastening mount for snapping and locking said fastening portion in said fastening mount when said fastening portion is inserted into said fastening mount, said locking structure blocking removal of said fastening portion from said fastening mount, said locking structure being arranged for rotating displacement of the breathing mask in relation to said fastening mount when said locking structure blocks said fastening portion in said fastening mount.

9. A combination in accordance with claim 8, wherein:

said locking structure includes an undercut defined by said fastening portion, said undercut being arranged on a side of said fastening portion facing the safety helmet when said fastening portion is inserted into said fastening mount;

said locking structure includes a spring element on the safety helmet, said spring element being arranged to fit into said undercut when said fastening portion is inserted into said fastening mount to block removal of said fastening portion from said fastening mount.

10. A combination in accordance with claim 9, wherein:

pressing means including a push rod selectively activateable by the user to move said spring element out of said undercut.

11. A combination in accordance with claim 10, wherein:

said push rod is arranged in said breathing mask bracket.

12. A combination in accordance with claim 8, wherein:

said arc-shaped contour of said fastening portion of said breathing mask bracket is an outer contour;

said arc-shaped contour of said fastening mount on the safety element is an inner contour.

13. A combination in accordance with claim 11, wherein:

said arc-shaped contour of said fastening portion of said breathing mask bracket is an outer contour;

said arc-shaped contour of said fastening mount on the safety element is an inner contour.

* * * * *